United States Patent [19]

Ando

[11] Patent Number: 4,823,509

[45] Date of Patent: Apr. 25, 1989

[54] SELF-CLOSING DOOR SEALING STRUCTURE

[76] Inventor: Kazuaki Ando, 418, Aza Kawaharabata, Amagasaki-shi, Hypgo, 661, Japan

[21] Appl. No.: 154,384

[22] Filed: Feb. 11, 1988

Related U.S. Application Data

[62] Division of Ser. No. 896,861, Jul. 1, 1986.

[30] Foreign Application Priority Data

Nov. 27, 1984 [JP] Japan ..... 59-180317[U]
Mar. 26, 1985 [JP] Japan ..... 60-63073

[51] Int. Cl.[4] ..... E06B 7/20
[52] U.S. Cl. ..... 49/303
[58] Field of Search ..... 49/303, 306, 316

[56] References Cited

U.S. PATENT DOCUMENTS 1,322,732 11/1919 Schatz .
2,248,719 7/1941 Owen ..... 49/303 X
2,862,262 12/1958 Shea ..... 49/303
3,019,493 2/1962 Walenga ..... 49/303 X

FOREIGN PATENT DOCUMENTS 2702031 7/1978 Fed. Rep. of Germany .

*Primary Examiner*—Philip C. Kannan

*Attorney, Agent, or Firm*—Birch, Stewart, Kolasch & Birch

[57] ABSTRACT

A self-closing door sealing structure is provided with an arrangement for keeping a self-closing fire door in close contact with a three-sided frame in a passage when the sliding fire door is closed so that no smoke or fumes may pass. A first unit is formed so that a sliding door (1) can be moved horizontally so as to be brought into close contact, when the sliding door is closed, with the three-sided passage frame via inclined guides (6) on a side post (18) in the passage frame and inclined guides (4A), (5) which are disposed at the upper and lower portions of the sliding door (1). A second unit is formed so that, when the sliding door (1) is closed, it press-contacts a retractable support frame (47) and an auxiliary frame (36). The auxiliary frame (36) is retracted into an inverted-L-shaped hook frame (32) by an inclined guide member provided behind the sliding door (1). In normal operation, the sliding door (1) is fully opened and held to enable a person to pass through the opened position. When a fire occurs, an electromagnetic release (E) is unlocked manually or by the operation of a smoke and heat sensor so that the sliding door (1) is closed automatically. Upon closing, the sealing structure is adapted to hermetically seal the three-sided frame in the passage.

2 Claims, 6 Drawing Sheets

SELF-CLOSING DOOR SEALING STRUCTURE

This application is a divisional of copending application Ser. No. 896,861, filed on July 1, 1986.

TECHNICAL FIELD

The present invention relates to a self-closing sealing structure in which, when a sliding door is completely closed, a doorway or three-sided frame is hermetically sealed to thereby prevent the passage of smoke.

BACKGROUND ART

A sliding fire door has previously been disclosed in the specifications of Japanese Patent Laid-Open No. 9858/1980 and Japanese Utility Model Publication No. 107577/1980 wherein opening of the door is accomplished by a manual operation, and closing is automatically effected with an adjustable force which varies the returning speed provided by an elastic device in order to vary the time of closing of the sliding fire door. In this door, a self-closing action begins the instant that a restraint is released by the action of a smoke sensor or a heat sensor. A suspension door provided with a self-closing function only is disclosed in the specification of Japanese Patent Laid-Open No. 123236/1979; and a sliding fire door is disclosed in the specification of Japanese Patent Laid-Open No. 138692/1984 wherein a smoke-shielding plate is perpendicularly provided toward a ceiling.

The above-described sliding fire door and suspension door, however, provide insufficient security in terms of protecting people from a fire, because they are incapable of preventing an outflow of harmful smoke when they are closed and this leads to a problem in that such doors are unsuitable for many purposes.

The aforementioned sliding fire door is unsuitable in practice since harmful smoke leaks out from a space formed between both ends of the door in the vicinity of a suspension wheel.

SUMMARY OF THE INVENTION

Accordingly, it is a primary object of the present invention, which obviates the above-noted conventional defects, to provide an inexpensive sliding fire door (hereinafter referred to as a sliding door) having a sealing structure which provides for protection from a fire, including the smoke which is produced. This sliding fire door is arranged so that, in order to cope with an emergeny caused by fire and noxious smoke spreading in advance of the fire, the sliding door may be opened manually when conditions are normal, but performs a self-closing action upon the automatic sensing of smoke or heat and comes into close contact with a three-sided passage frame to prevent the passage of smoke. Thus, not only is the spreading of the fire hindered, but also smoke-shielding effects are obtained in order to protect the people present from the smoke, which is the most dangerous factor present when a fire occurs.

The self-closing door sealing structure according to the present invention includes a first unit which provides a means for keeping the sliding door in close contact with the three-sided passage frame when the sliding door is closed. The sliding door moves toward the passage frame via inclined guide members disposed at the upper and lower portions of the sliding door as well as at a side post of the passage frame. A second unit provides means for making the sliding door press against a retractable support frame provided within the side post of the passage frame and an auxiliary frame when the sliding door is closed. The auxiliary frame is made to retract into an inverted L-shaped hook frame by inclined guide members disposed at the upper and lower portions of the sliding door. The two units, as well as the sliding door, are suspended from suspension wheels so that the structure can be rolled. The sliding door is closed by a self-closing force with a constant velocity except when being held open. The sliding door is held open by the constraint of an electromagnetic release which may be operated by a smoke sensor or heat sensor. The sliding door can only be opened manually.

Hence, according to the present invention, multiple sensors such as a smoke sensor, a heat sensor, or the like function in response to a fire which occurs at any time, so that an opening portion defined as a passage is shut off by immediately releasing the constraint on the sliding door regardless of the location of people. At the same time, the three-sided frame in the passage is completely brought into close contact with the closed sliding door, thereby preventing an outflow of harmful smoke and a spread of the fire.

BRIEF DESCRIPTION OF DRAWINGS

The present invention will become more fully understood from the detailed description given hereinbelow and the accompanying drawings which are given by way of illustration only, and thus are not limitive of the present invention, and wherein:

FIG. 1 is a schematic elevation showing a configuration of the present invention;

FIG. 2 is a partially cutaway plan view thereof;

FIGS. 3, 4 and 5 are partially cutaway side views of a principal portion, FIGS. 3 and 4 showing the sliding door closed, FIG. 5 showing the sliding door opened;

FIG. 6 is a partially cutaway perspective general view;

FIG. 7 is a schematic plan view showing another configuration of the present invention;

FIGS. 8 and 9 are plan views, FIG. 8 showing the sliding door opened, FIG. 9 showing the same door being closed;

FIGS. 10 and 11 are expanded views of a principal portion with parts broken away, FIG. 10 showing the structure just before the sliding door is completely closed, FIG. 11 showing it when the same door is fully closed;

FIG. 12 is an assembly perspective view of a frame portion;

FIGS. 13 and 14 are exploded perspective views of a press-contact member or hook frame; and FIGS. 15 and 16 are expanded elevations, FIG. 15 showing a state in which a contact member carried by the door comes in contact with a roller immediately before the sliding door is fully closed, FIG. 16 showing it when the same door is completely closed.

DETAILED DESCRIPTION OF PREFERRED EMBODIMENTS

Figure 1:
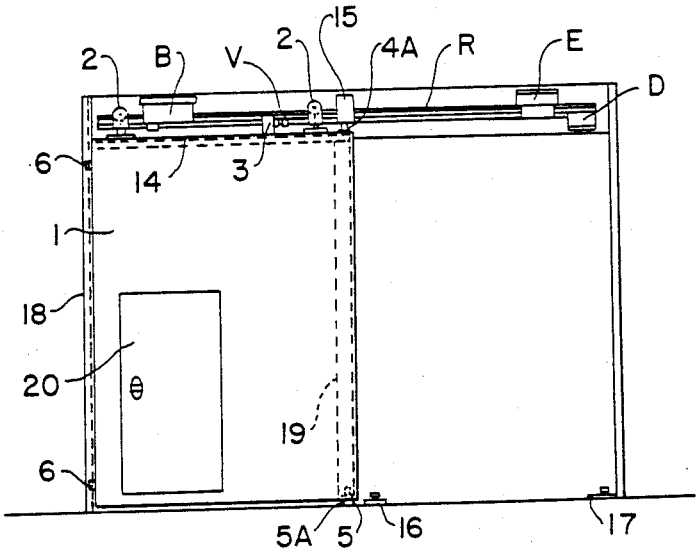
FIGS. 1 to 6 inclusive show a first unit of the present invention in which a sliding door comes in close contact with a three-sided frame in a passage by virtue of a parallel movement just before the closing.

A first unit according to the present invention will hereinafter be described more fully with reference to the accompanying drawings.

At the outset, a construction of the sliding door employed for the present invention will be explained with reference to FIGS. 1 and 2 as follows:

A supporting member 2 is mounted by a hinge 12 on the upper side of the sliding door 1. This supporting member 2 has a pulley 10 attached thereto. The groove of the pulley receives a rail R and is so suspended as to be rollable thereon. The rail R is provided beforehand on the upper portion of a wall surface. A wire W which is retractable by a door closing speed adjuster B is inserted through a wire stopper 3 which is vertically installed on the upper side 1C of the sliding door 1 and further extends from a fastener V to wire motion preventer D. The fastener V engages with a stopping hook provided within an electromagnetic release E which is connected to be operated by a smoke sensor or a heat sensor (not illustrated). When the sliding door 1 is completely opened, the fastener V is held in position by the stopping hook. When the electromagnetic release E is actuated by a manual operation, or the electromagnetic release E automatically functions in accordance with the operation of the sensor which is actuated in response to the sensing of a fire, the fastener V is released so that the wire is pulled in the closing direction. Thus, the door closing action takes place until the sliding door is completely closed, while the sliding door 1 moves at a constant velocity.

Figure 2:
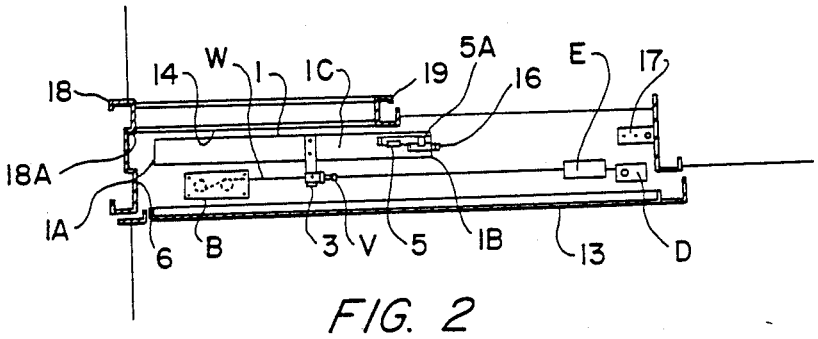
Figure 6:
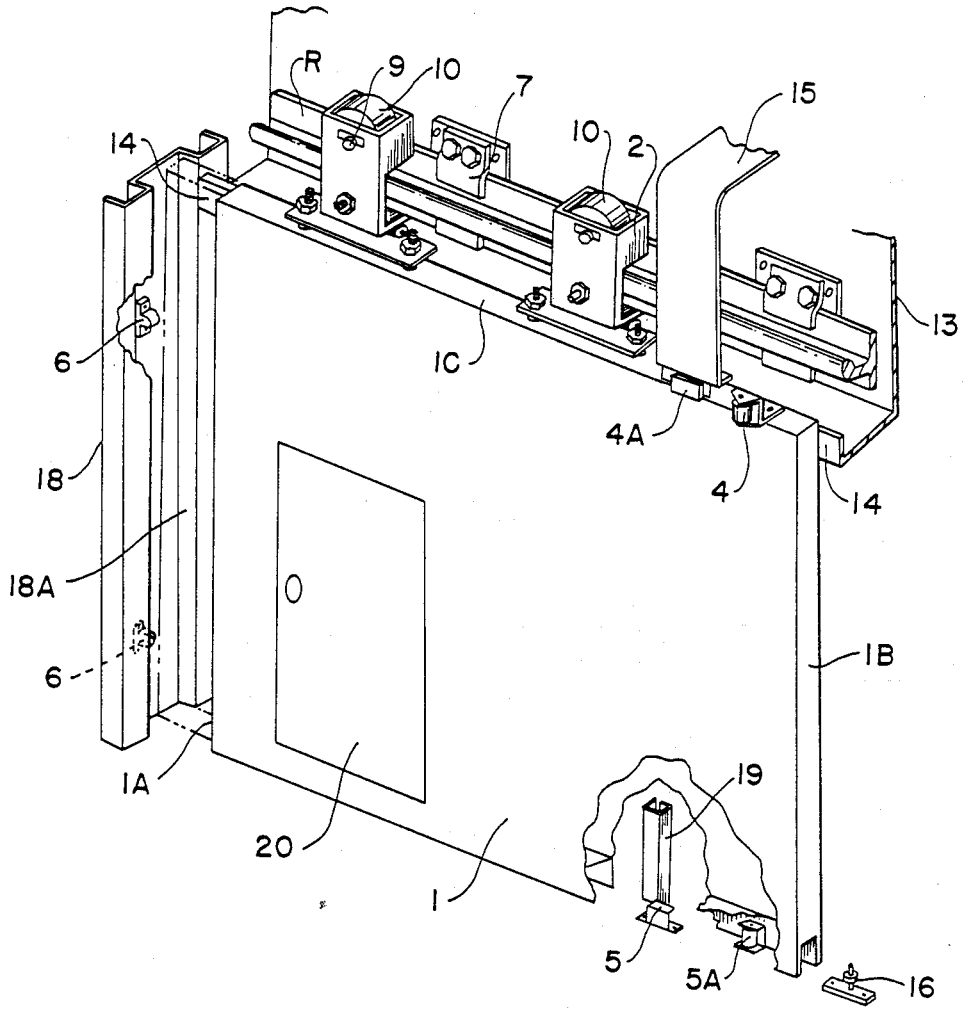

Just before the sliding door 1 is closed, an angular edge of a tip and surface 1A of the sliding door 1 comes into contact with a plurality of inclined guide members 6 which are fixed to the upper and lower angular edge portions of a side frame 18, FIGS. 1 and 6, serving as part of the three-sided frame that forms a doorway or passage; while at the same time, rollers 4, 5A pivotally secured to the upper and lower rear end portions of the sliding door 1 are respectively brought into contact with the oblique surface of a lower guide member 5 which is provided on the floor surface and with the oblique surface of an upper guide member 4A fixed to a suspension plate 15 disposed on the side of a lateral frame. As a result, when the sliding door 1 is closed the upper and lower portions thereof parallelly move along equal-angle oblique surfaces of the respective guide members; and the rear surface of the sliding door 1 is brought into close contact with the three-sided frame forming the passage (opening portion). Thus, simultaneously the sliding door 1 engages the side post 18, a longitudinal post 19 and a contacting portion 14 defined as the lower side of a cover attached to an upper frame, thereby blockading the passage.

The operation of the first unit according to the present invention is set forth below with reference to FIGS. 3 to 6 inclusive.

Figure 3:
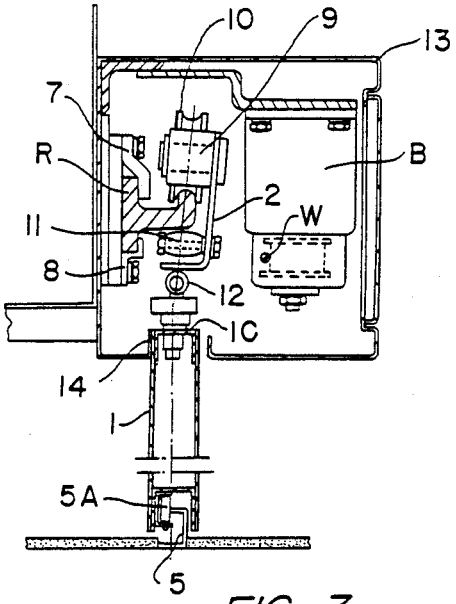

FIG. 3 shows the sliding door in its closed position. The substantially L-shaped supporting member 2 is pivotably or obliquely movable and is fastened with a hinge 12 which is screwed to the upper side IC of the sliding door 1. The supporting member 2 has a pulley 10 installed on the upper part of the supporting member 2. The pulley 10 is supported on the arc-shaped end surface of the rail R which is laterally provided on the upper frame. Thus, the pulley can pivot about the axis of the hinge 12. The reference numeral 11 stands for a barrel-like roller which is rotatably secured to the supporting member 2 so that this roller is proximate to the lower surface of the rail R. The roller 11 acts as a stopper to prevent the pulley 10 from disengaging from the rail on account of an impact to the sliding door 1 or a spring-up of the sliding door 1. Inasmuch as there is a slight gap formed between the lower surface of the rail R and the barrel-like roller 11, even if the support member moves obliquely, no problems arises when the pulley 10 rolls on the rail R.

An inverted U-shaped groove is formed in the lower end portion of the sliding door 1, and a roller 5A is parallelly secured to the vertical wall disposed on one side thereof. A lower guide member 5 which includes an inclined surface and is adjustable in its front and back movement is perpendicularly provided on the floor surface. With this arrangement, the sliding door 1 when being closed proceeds parallel to the above-mentioned inclined surface after the roller 5A has come in contact with the lower guide member 5, whereby the sliding door 1 is brought into close contact with the contacting portion 14 on the lower side of the cover 13 provided on the side of the upper frame.

Figure 4:
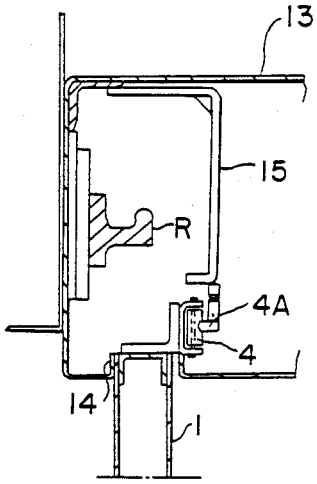

It can be observed from FIG. 4 that a roller 4 which is rotatably and pivotally secured to an angle member attached to the upper side 1C of the sliding door 1 is vertically disposed so that it will engage with the inclined surface of the upper guide member 4A whose movement is adjustable from front to rear with respect to a suspension plate 15 suspended from the upper frame. The suspension plate 15 has the configuration shown in FIGS. 4 and 6. Simultaneously when the angular edge of the tip end surface 1A of the sliding door 1 impinges upon an inclined guide member 6, the rollers 4, 5A butt against the inclined surfaces of the guide members 4A, 5, respectively. To ensure this result, the respective guide members are previously adjusted forward or backward as necessary; furthermore, inspection and maintenance are carried out in order to provide that the sliding door 1 moves as desired.

Figure 5:
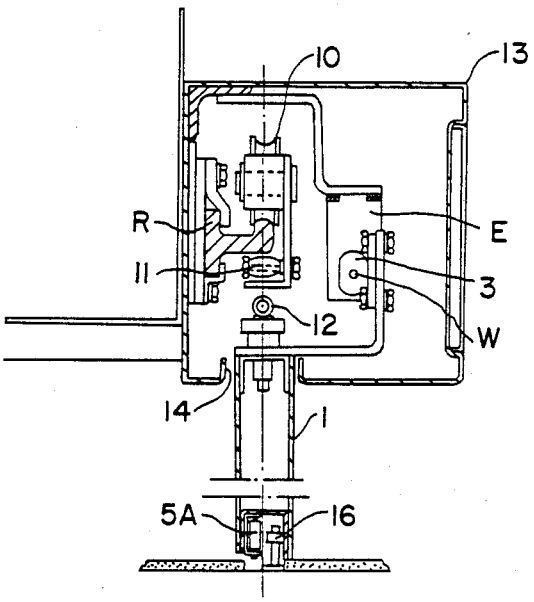

In FIG. 5, the sliding door 1 has been opened by a manual operation and hence the tip end surface 1A thereof separates from the side post 18; and the rear surface thereof separates both from the contacting portion 14 defined as the lower side of the cover of the upper frame and from the longitudinal frame 19. In this case, the size of a gap formed therein is in proportion to a distance at which it parallelly moves away from the frame members. Under such circumstances, both the hinge 12 provided at the lower portion of the supporting member 2 and the pulley 10 disposed on the rail R from which the sliding door 1 is suspended are centered on a perpendicular line. On the side of the lower end of the sliding door 1, a rotatable guide pulley 16 which is vertically provided on the floor surface comes in contact with the vertical wall opposite to the wall to which the roller 5A is pivotally secured, thereby preventing any shaking caused by the forward opening of the sliding door 1.

In FIG. 6, the sliding door 1 approaches the side post 18 which is part of the three-sided passage frame designed to be closed and then moves normal to its original direction through the operation of the inclined surfaces of the respective guide member. The tip end surface 1A of the sliding door 1 comes in contact with a groove wall 18A of the side post 18. Also, the rear surface of the sliding door is brought into contact with the longitudinal post 19 and the contacting portion 14 of the cover, thus closing or blockading the three-sided frame in the passage.

A pass-through door 20 is pivotally secured to the sliding door 1. A self-closing elastic device is provided so that this pass-through door can be opened in one direction, viz., the direction leading outside the room. The pass-through door 20 chiefly serves as a passage for emerency use through which people who fail to escape and are left in the room after the sliding door has closed can pass. Therefore, this pass-through door 20 is indispensable in terms of protection from a fire.

The first unit according to the present invention is thus constructed so that the fastener V provided at the end of the wire W is restrained by the electromagnetic release E when the sliding door has manually been completely opened. Thus, the sliding door 1 is held open, with the opening portion serving as the passage.

When the restraint of the sliding door is released, viz., in case the sensor functions in response to the smoke or the heat generated by a fire and the electromagnetic release E releases the fastener V, the restraint of the fastener V is released by a string or cord pulling operation of the elctromagnetic release, the sliding door 1 moves forward in the closing direction by dint of the constant speed returning force of the door closing speed adjuster B which includes a built-in elastic device. Upon movement of the door, the angular edge of the tip end surface 1A of the sliding door and the rear rollers 4, 5A all simultaneously abut upon an inclined surface, whereby the sliding door 1 forcibly moves forward normal to its original direction. As a result, the sliding door 1 is brought into close contact with the groove wall 18A of the side post, the longitudinal post 19 and the contacting portion 14 defined as the lower side of the cover provided on the side of the upper frame, viz., with the three-sided frame forming the opening portion for the passage, thereby maintaining a closed position wherein no smoke can flow past. Thus, the closing operation of the sliding door 1 is completed. Hence, the spreading of the fire blazing up in the room is prevented by the fire resistant material of the sliding door 1, and at the same time the flow of noxious smoke which is the actual cause of a large number of deaths in a fire is shut off in the passage, whereby no smoke is leaked outside the room. As a result, the damages caused by the fire are minimized.

People who fail to escape from the area of the fire and are left on the wrong side of sliding door 1 are able to open the pass-through door 20 which is pivotally installed in the sliding door and thus may take refuge from the fire without taking the trouble to open the heavy sliding door 1 that has been cloesd. In this respect, the present invention is useful in avoiding a serious situation caused by a fire, since the escape outlet for emergency use is prepared beforehand. Furthermore, if some fluorescent materials are added to the pass-through door, this door can be effectively used during the night time.

The second unit according to the present invention will hereinafter be more fully described with reference to the accompanying drawings.

Figure 7:
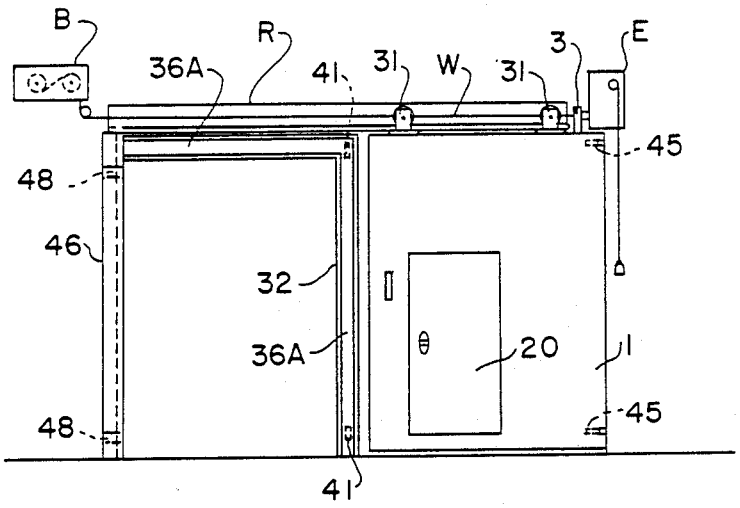
FIGS. 7 to 16 inclusive show a second unit of the present invention in which owing to the parallel movement just before the closing the sliding door is brought into close contact wtih the three-sided frame in the passage by dint of an elastic pressure.
Figure 8:
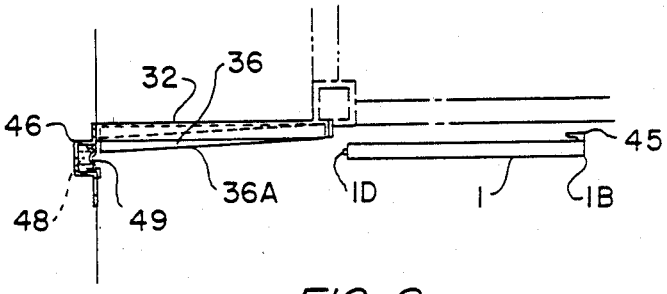

This construction of the invention is first explained with reference ot FIGS. 7 and 8. A side post 46 serving as part of a three-sided frame of an opening or doorway is U-shaped and has a retractable support frame 47 mounted therein. The retractable support member has a recessed portion 49 and a cylindrical compressed type elastic device 48 bears against the retractable support member 47. An auxiliary frame 36 fits freely in an inverted L-shaped hook frame 32 so that the auxiliary frame 36 is more floatable as it approaches the side post. As shown in FIG. 8, as close contact surface 36A obliquely approaches the side post 46, the auxiliary frame 36 is made to protrude from the L-shaped hook frame 32.

Adjacent the upper frame, the wire W is taken up and rewound by the door closing speed adjuster B, similar to the first unit, and is inserted through the wire stopper 3 which is perpendicularly installed on the sliding door 1. By virtue of the fastener V secured to the end portion thereof, the sliding door 1 is arranged to be stationary because of its being restrained by the electromagnetic release E when the sliding door 1 is completely opened. Rolling wheels 31, by which the sliding door 1 is suspended in the second unit, do not necessarily employ a member mounted by a hinge as utilized in the first unit, inasmuch as the sliding door 1 in the second unit makes almost no oblique motion.

Figure 9:
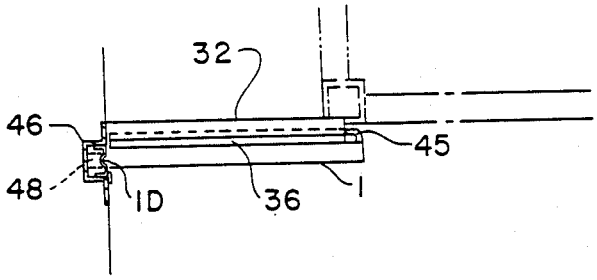

The sliding door 1 as shown in FIG. 9 is in a completely closed state and parallel close contact of the sliding door 1 with the hook frame 32, and the auxiliary frame 36 as well, is therefore effected. Moreover, a protrudent member 1D of the tip end surface 1A of the sliding door 1 closely engages with the recessed portion 49 of the support frame 47 of the side post, whereby the sliding door 1 completely and closely shuts off the three-sided frame serving as the doorway or passage. Thus, the sliding door 1 accomplishes the blockading of any outflow of smoke.

Figure 10:
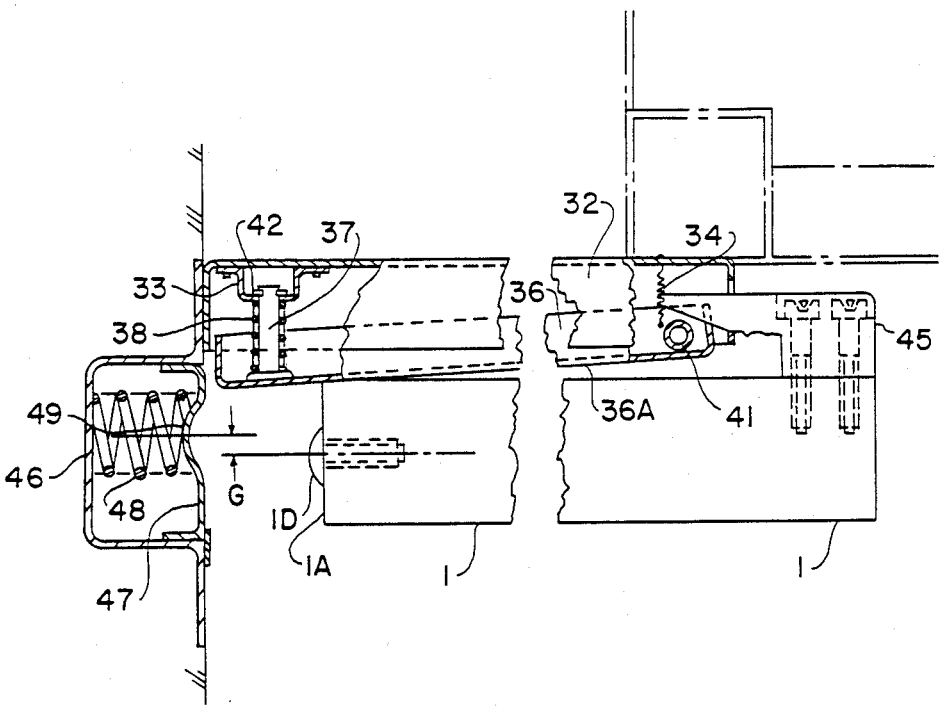

The retractable auxiliary frame 36 freely clears the support frame 47 as shown in FIG. 10. The support frame 47 acted on by the elastic device shown in FIGS. 10, 11 and the hook frame serving as an inverted L-shaped groove member containing auxiliary frame 36 provides a three-sided frame which is elastically movable. Just before the sliding door 1 is completely closed, contact members 45 carried by the sliding door 1 butt against rollers 41 which are pivotally installed at the upper and lower portions on the perpendicular side of the auxiliary frame 36. The contact members have protrudent oblique surfaces and are provided at the upper and lower portions of the rear end of the sliding door 1. The auxiliary frame 36 is rendered floatable relative to the hook frame 32 through the use of tension springs 34. Upon closing the door, the semi-circular protrudent member 1D secured to the tip end surface of the sliding door 1 impinges upon the support frame 47 provided within the side post. Thereafter, the protrudent member 1D enters into the semi-circular recessed portion 49 of the support frame 47 while sliding laterally, and the rear surface of the sliding door 1 elastically presses against the close contact surface 36A while slightly decreasing the protruded width (a distance G) of the auxiliary frame 36. Similarly, the tip end surface 1A of the sliding door 1 presses against the support frame 47 provided within the side post 46. Such being the case, the three-sided frame in the passage is kept in close contact with the rear surface of the sliding door 1, thereby hindering any smoke from permeating from around the peripheral portions of the door and into the passage.

Figure 11:
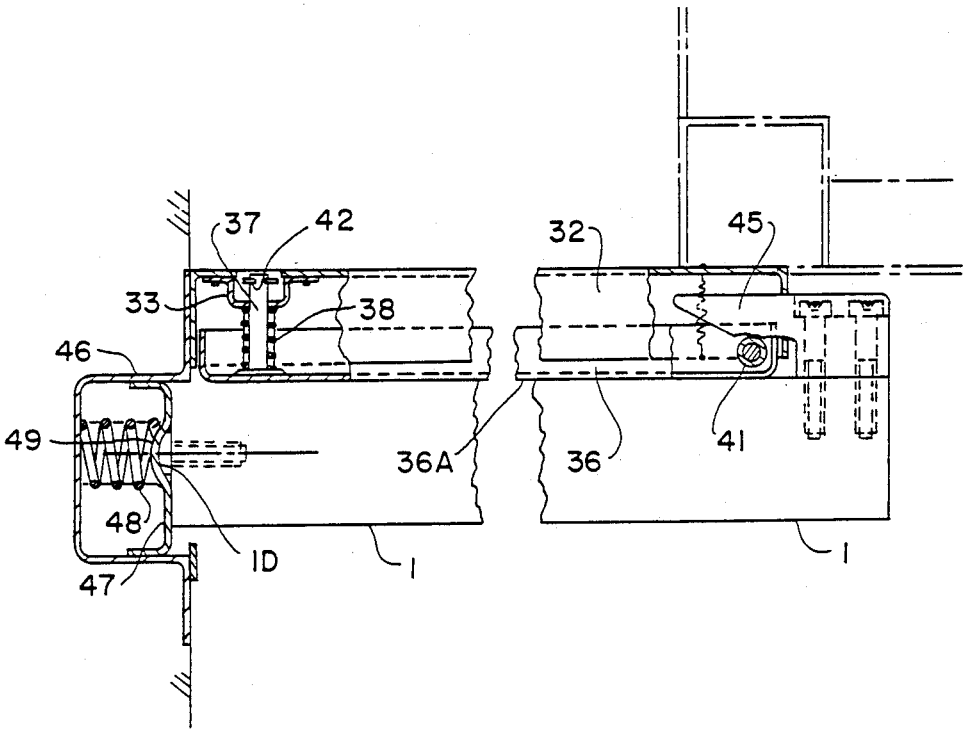
Figure 13:
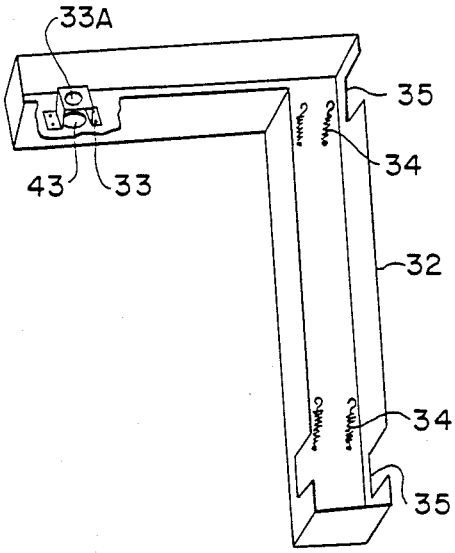

Consequently, the aforementioned auxiliary frame 36 becomes, as shown in FIG. 11, parallel with the hook frame 32 when the sliding door 1 is closed. In this regard, as the auxiliary frame 36 approaches the side post, the protruded portion is retracted so as to become parallel, in this regard the retracted distance (the distance G)

is predetermined. The position of the recessed portion 49 of the support frame 47 may deviate by the distance G from the central line of the protrudent member 1D of the sliding door 2 as shown in FIG. 10. The engagement of the recessed portion 49 with the protrudent member 1D provides for the proper positioning of the closed door, as shown in FIG. 11. The hook frame 32, as shown in FIG. 13, has one end of the tension springs fastened thereto on the upper and lower sides in the longitudinal direction, that is, in the perpendicular direction. Recessed portions 35 are provided to allow the free insertion of the contact members 45 disposed on the side of the sliding door 1.

A U-shaped receiving member 33, shown in FIGS. 10, 11 and 13, is mounted on the end portion of the lateral side by aligning it with a small hole 43 formed in the hook frame 32. This receiving member 33 cooperates with the auxiliary frame 36 in a manner set forth below.

Figure 14:
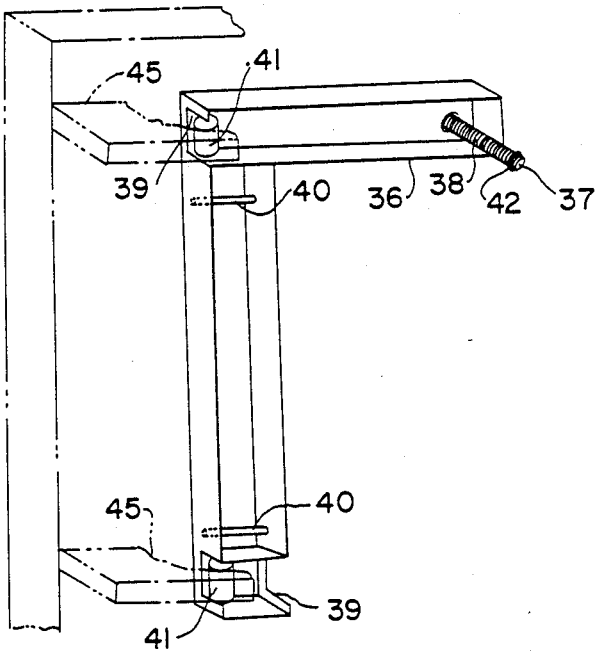

The auxiliary frame 36 engages with the hook frame 32 and is, as shown in FIG. 14, formed of an inverted L-shaped groove member. A guide shaft 37 with a push spring 38 can freely be inserted into the small hole 43 formed in the hook frame 32 and into a hole formed in the receiving member 33, this guide shaft 37 being vertically provided at the lateral side end portion in the horizontal direction. On the longitudinal side (perpendicular direction), rollers 41, which are brought into contact with the contact members 45 projecting from the sliding door 1, are rotatably and perpendicularly fitted in a recessed portion 39 formed in the notched side wall. Stop rods 40 are provided to secure one end of the tension springs 34.

Figure 12:
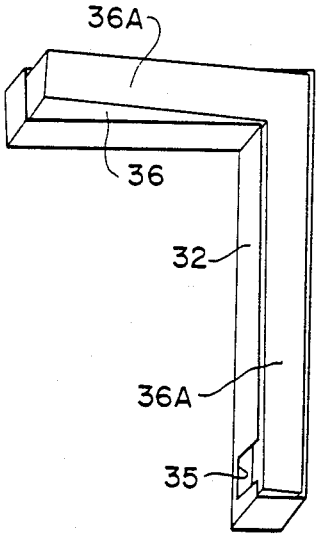

FIG. 12 shows the above-mentioned auxiliary frame 36 positioned within the hook frame 32. As for the assembly procedures, firstly in the perpendicular direction, the tension springs 34 provided on the side of the hook frame are put over the top rods 40 installed on the side of the auxiliary frame. Thereafter, the guide shaft 37 disposed in the horizontal direction is inserted into a hole 33A formed in the receiving member 33 provided on the side of the hook frame; and a stop ring 42 is press-fitted from the small hole 43 in a peripheral groove formed in the guide shaft which is inserted into the rear surface of the receiving member, thus completing the engagement of the two members.

After this assembly has been finished, the two members are positioned such that, as shown in FIG. 12, the auxiliary frame 36 increases in height as it approaches its end portion on the lateral side; and the auxiliary frame 36 thus has a surface inclined to the horizontal surface of the hook frame 32.

Figure 15:
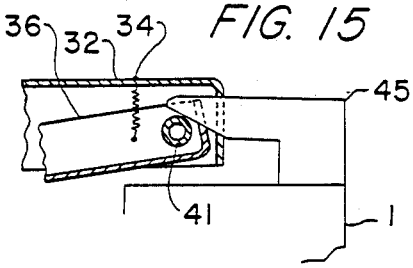
Figure 16:
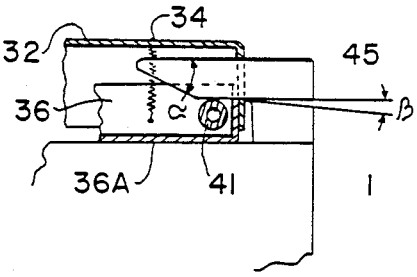

The inclined surface formed at an angle (acute angle) at the tip of the contact members 45 projecting on the side of the rear portion of the sliding door 2, as shown in FIGS. 15 and 16, impinges upon the rollers 41 of the auxiliary frame 36, at which time the auxiliary frame 36 moves by the stretching of the tension springs 34, whereby the auxiliary frame 36 is allowed to float relative to the hook frame 32; while at the same time, the floating end portion on the lateral side is also forcibly pressed by the motion that the protrudent member 1D of the sliding door 1 causes as its fits in the recessed portion 49 formed in the support frame while sliding laterally. Thus, the auxiliary frame 36 enters the hook frame 32. As a result, the close contact surface 36A of the auxiliary frame 36, as shown in FIG. 16, becomes parallel with the hook frame and presses against the rear surface of the sliding door 1, so that the three-sided frame in the passage is completely sealed. Therefore, smoke shielding is accomplished. When the sliding door 1 is being closed, the contact member 45 makes the roller 41 bear against the undulated portion formed on the line of an angle (slightly acute angle) of the inner surface of the contact member. The contact member also resists any advancement of the roller caused by the generation of an unexpected door opening force, the arrangement being such that the roller 41 intensively presses against the above-described undulated portion formed on the contact member by reason of the spring force of the tension spring thereby to produce an anti-slipping result for the contact member.

In the second unit according to the present invention, inasmuch as there is a sealing effect in which each of the close contact surfaces of the three-sided passage frame elastically presses against the sliding door 1, no forces or twisting are created in effecting the pressing contact. In addition, the sealing condition is entirely complete by virtue of the operation of the elastic devices, whereby the spread of a fire is positively prevented and simultaneously smoke-shielding effects are procured. These factors are indispensable for the prevention of the spread of the fire.

The operation of the sliding door is the same in both the first and second units; namely, the door is initially opened manually. The self-closing function works by a cord or string pulling operation or the operation of a electromagnetic release (interlocking with a sensor) and hence the smoke-shielding operation and the door closing operation are immediately carried out upon sensing the heat or the smoke generated when the fire occurs. Accordingly, the present invention is effective in the prevention of damage caused by dangerous smoke.

INDUSTRIAL APPLICABILITY

The present invention is advantageous since a self-closing door sealing structure according to the present invention has the convenience of being readily added to any sliding fire door which is to be installed at any entrance or exit, for exmaple in the rooms of a building, such as a hospital in conformity with the fire regulations. The sliding door performs a double function in providing a shielding from smoke and hindering the spread of a fire and is thus quite helpful in terms of fire prevention. Mass-production can be employed at relatively low costs to produce the sealing members for keeping the three-sided passage frame in close contact with the sliding door. In this respect, people who are obliged to install the sliding door can lessen the heavy expense involved and thus inevitably foster its use. As a result, the present invention contributes to improved fire safety.

I claim:

1. A sliding door sealing structure comprising a sliding door having an open and a closed position, a passage frame having three sides and positioned to be closed by said sliding door, a first side of said three sides of said passage frame being a side post, a retractable support frame being located in said side post, second and third sides of said three sides of said passage frame being an inverted L-shaped frame having an auxiliary frame retractably mounted therein, contact members, each including an angled surface, mounted at upper and lower portions of said sliding door on a side of said door facing said inverted L-shaped frame, means positioned in said inverted L-shaped frame for engagement by said contact members upon the closing of said sliding door, and said sliding door in said closed position moves said retractable support frame in said side post and said retractable auxiliary frame in said inverted L-shaped frame, whereby the sliding door is sealed by pressing contact of said sliding door with said three sides of said passage frame when said sliding door is closed.

2. A sliding door sealing structure as recited in claim 1 wherein said means positioned in said inverted L-shaped frame for engagement by said members are rollers.

* * * * *